US005098109A

United States Patent [19]

Wayne

[11] Patent Number: 5,098,109

[45] Date of Patent: Mar. 24, 1992

[54] PARACHUTE GAME

[76] Inventor: Mark Wayne, 29436 Briarbank Ct., Southfield, Mich. 48034

[21] Appl. No.: 573,282

[22] Filed: Aug. 24, 1990

Related U.S. Application Data

[63] Continuation of Ser. No. 385,466, Jul. 27, 1989, abandoned.

[51] Int. Cl.[5] ..... A63B 65/00; A63B 67/00

[52] U.S. Cl. ..... 273/400; 273/344; 446/49

[58] Field of Search ..... 273/424, 428, 398–402, 273/344; 446/49–54

[56] References Cited

U.S. PATENT DOCUMENTS

| | | | |
|---|---|---|---|
| 1,492,709 | 5/1924 | Hall | 446/53 |
| 2,640,699 | 6/1953 | Garbo | 273/424 |
| 3,139,700 | 7/1964 | Wyrick . | |
| 3,179,412 | 4/1965 | Niederberger | 273/424 X |
| 3,201,128 | 8/1965 | Palovik | 273/344 |
| 3,709,495 | 1/1973 | Krombein | 273/344 |
| 3,798,829 | 3/1974 | Worley | 446/51 |
| 4,038,776 | 8/1977 | Filipeli | 446/52 |
| 4,077,155 | 3/1978 | Bruntmyer | 446/53 X |
| 4,182,074 | 1/1980 | Ortiz | 446/51 |

FOREIGN PATENT DOCUMENTS

| | | | |
|---|---|---|---|
| 915606 | 7/1946 | France | 273/428 |

OTHER PUBLICATIONS

The Sporting Goods Dealer, 4–1972 p. 18 Toss-um.

*Primary Examiner*—Paul E. Shapiro

*Attorney, Agent, or Firm*—Gifford, Groh, Sprinkle, Patmore and Anderson

[57] ABSTRACT

A parachute game includes a hand-tossable parachute assembly that is held by a player and is tossed at a target hoop. The parachute assembly comprises at least one hemispherical canopy attached to a body portion by a number of conically arrayed cords. The body portion includes at least one ring at its top end for cord attachment. In one embodiment, the body portion includes axially-placed stabilizing vanes. At its bottom side, the body portion may have defined therein a concave depression to assist in retarding the free fall of the body as it travels through the air.

7 Claims, 2 Drawing Sheets

PARACHUTE GAME

This is a continuation of copending applications Ser. No. 07/385,466, filed on Jul. 27, 1989, now abandoned.

BACKGROUND OF THE INVENTION

I. Field of the Invention

The present invention relates generally to children's toys. More particularly, the present invention relates to a parachute game including a hand-tossable parachute assembly that is held by a player and is tossed at a target hoop.

II. Description of the Relevant Art

Games are popular and Varied. A secret to a successful game is to provide a game that is challenging as well as fun. A game that also involves physical interaction typically proves highly successful.

The problem with challenging, fun and physically interactive games is that they are often not playable indoors and, when played out-of-doors, require a considerable amount of playing area.

Game producers have generally failed in providing challenge, fun and physical activity into a single game. Such a game would be beneficial to players of all ages, although such a game is currently unavailable.

SUMMARY OF THE PRESENT INVENTION

The present invention provides a game that is simultaneously challenging, fun and physically interactive and discloses a parachute target game. The parachute game includes a hand-tossable parachute assembly that is held by a player and is tossed at a target. Preferably the target is a hoop horizontally placeable upon the ground or the floor of the room.

The parachute assembly comprises at least one hemispherical canopy attached to a body portion by a number of conically arrayed cords. The body portion is preferably composed of an injected, foamed polymerized plastic having a protective coating such as a paint filmed thereover.

At its top end the body portion includes at least one ring for attachment to the canopy cords. To prevent twisting of the cords, two such rings are preferably fitted to the body portion whereby the rings are joined to the top of the body portion at their lower ends and are spaced apart at their upper ends thereby forming a "V" in cross section.

At the bottom side of the body portion there may be a concave depression to assist in retarding the free fall of the body portion as it descends after being tossed.

The body portion may also have axially provided thereon a number of stabilizing vanes. The vanes assist in minimizing twisting of the body portion after it has been thrown.

The game is played by placing the target hoop onto the ground or a floor or a similarly level surface. Thereafter each player rolls the canopy and body portion substantially into a ball, takes aim at the target hoop, and tosses the assembly into the air in the hope that the assembly lands within the hoop.

The parachute game of the present invention offers several significant advantages. The game is challenging, yet fun. Tossing the assembly requires physical interaction, yet no physical contact with other players is required and the game is thereby safe for play. The game may also be played indoors or out-of-doors. Furthermore, the game may be constructed of relatively inexpensive materials and may be neatly packed and easily stored. The game may be played by people of all ages.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
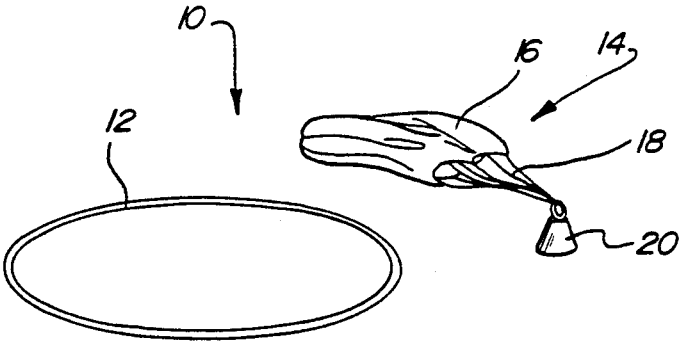
FIG. 1 is a peripheral view of the elements of the game according to the present invention.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a parachute game according to the present invention is illustrated generally as 10. The parachute game 10 includes a target portion 12 and a parachute assembly generally illustrated as 14. Although the target portion 12 is herein illustrated as being a hoop, it should be understood that other target structures such as bullseyes, open containers and the like may also be considered in game play.

The parachute assembly 14 includes a canopy 16, a plurality of cords 18, and a body portion 20.

Figure 2:
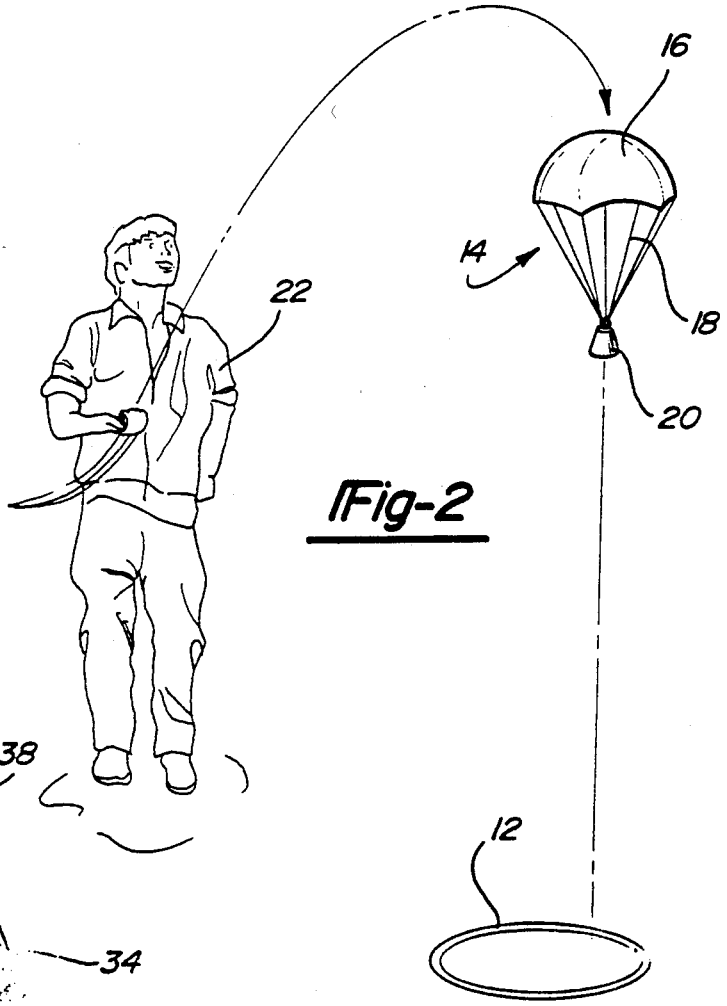
FIG. 2 is a peripheral view of the present invention illustrating a player participating in game play.

With reference to FIG. 2, the parachute game 10 is shown being used by a player 22. To play the game 10, the player 22 rolls the canopy 16, the cords 18 and the body portion 20 together, takes aim at the target 12, and releases the assembly 14 into the air in the general direction of the target 12. The object is to aim the assembly 14 so that it lands within the target 12.

As illustrated, when free falling, the canopy 16 becomes hemispherical by captured air to assist in retarding the speed of descent and to aid in accurate targeting. When this occurs, the cords 18 appear conically arrayed in their extended positions, as illustrated. Of course, more than one canopy 16 may be attached to the body portion 20.

Preferably each player 22 has his own assembly 14 for play, although the game 10 may include only one assembly for use by all of the players 22. Alternatively, the game 10 may be played by only one player 22.

Figure 3:
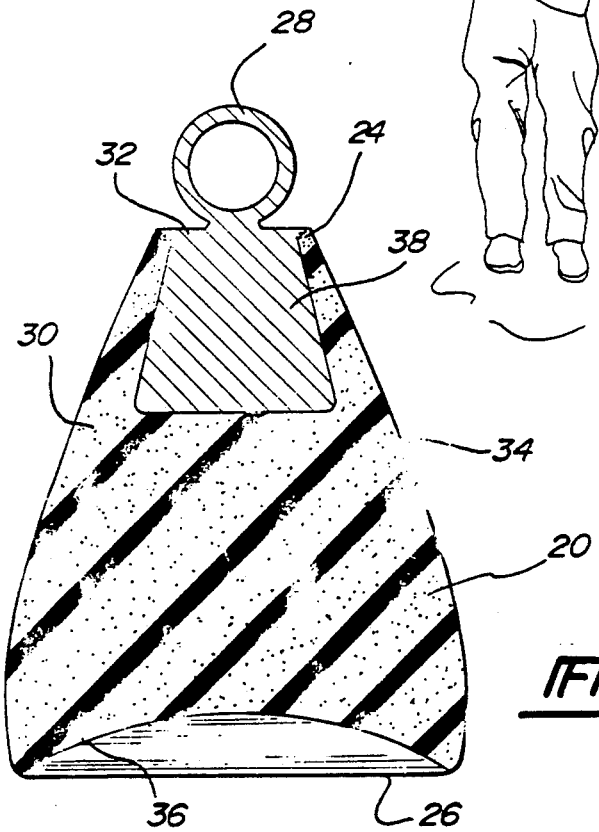
FIG. 3 is a cross-sectional view of a preferred embodiment of the body portion of the present invention.

With reference to FIG. 3, a detailed view of the body portion 20 is illustrated in cross section as a preferred embodiment. The body portion 20 comprises a body 30 including an upper end 24 and a bottom side 26. The upper end 24 has fitted thereto a cord attachment ring 28. The ring 28 is provided for removable attachment of the cords 18 (FIGS. 1 and 2) thereto.

The ring 28 is anchored to the body 30 by a ring base 32 that is preferably molded into the body 30.

The body 30 is preferably composed of a polymerized material such as an expanded or foamed plastic. The body 30 may therefore be produced by means of reaction injection molding. The body 30 is preferably covered by a painted or polymerized skin 34 for safety, durability, and to add aesthetic appeal.

The bottom side 26 includes a concave depression 36 centrally located thereon. The depression 36 further assists in retarding the free fall of the body portion 20 while increasing stability. The depth of the depression 36 may be varied to achieve optimum results of descent speed and playing accuracy.

At the under side of the ring base 32 different methods of balancing or weighting the body portion 20 may be fitted therewith. As illustrated, a weight 38 is situated therein around which the body 30 is thereafter molded. The weight 38 may be a conventional fishing-type weight or may be cast as one with the ring 28 and the ring base 32.

Figure 4:
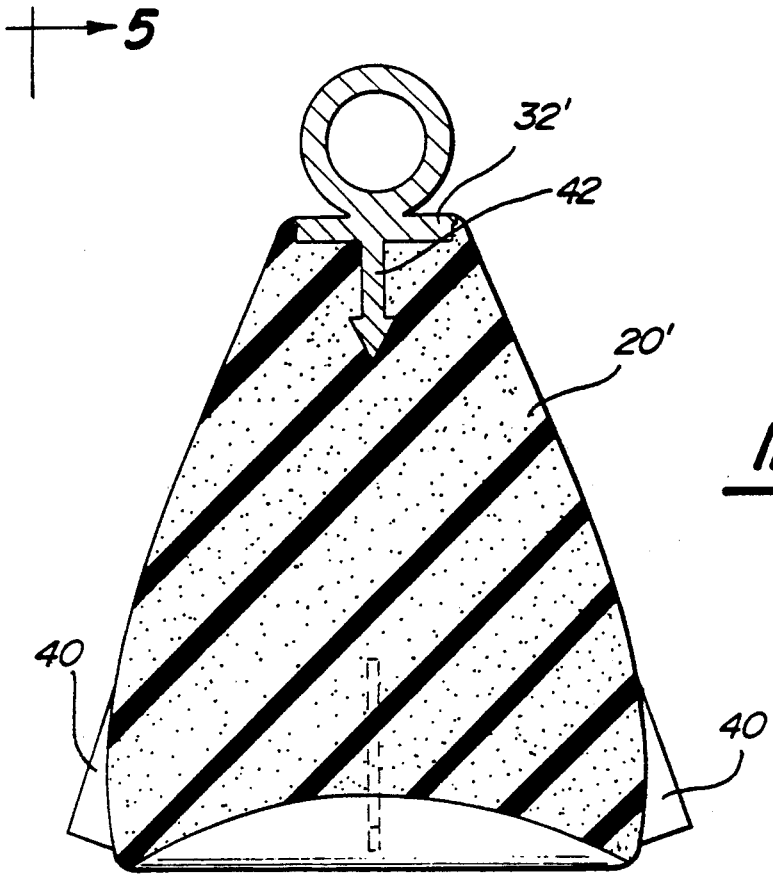
FIG. 4 is a view similar to that of FIG. 3 illustrating an alternate embodiment of the present invention.

Referring to FIG. 4, an alternate embodiment of the body portion, illustrated here as 20', is shown. According to this embodiment, a plurality of axially provided stabilizing vanes 40 are shown fitted exteriorly to the body portion 20'. The vanes 40 assist in the prevention of the twisting of the body portion 20' as it descends from its maximum-tossed elevation. Preferably there are four of the vanes 40 provided as the body portion 20', although more or less vanes 40 may be provided as optimum operation dictates.

A ring base 32' according to this embodiment is anchored by a ring base anchor 42. The ring base anchor 42 may either be molded as one with the body portion 20' upon manufacture or may be pressed in and force-fitted after molding.

To further minimize twisting upon descent, the attachment point of the cords 18 may also be modified.

Figure 5:
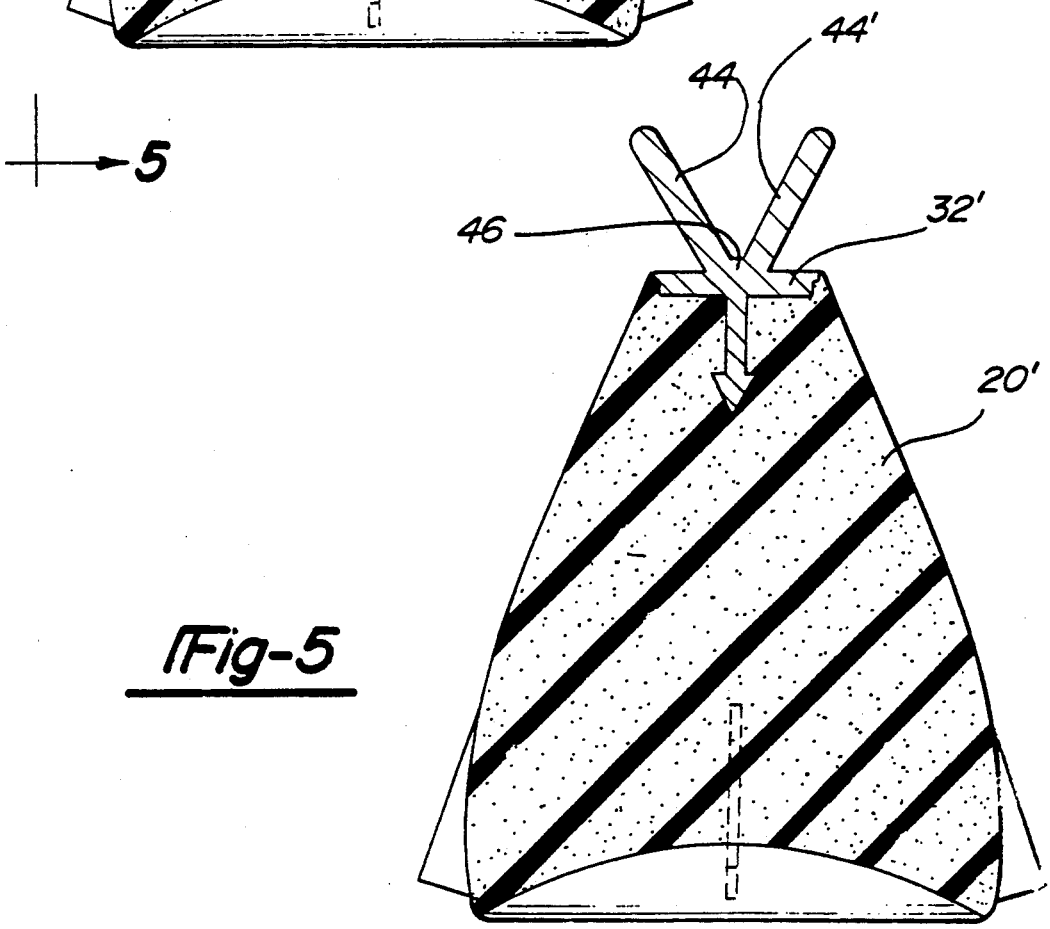
FIG. 5 is a view taken along lines 5—5 of FIG. 4.

Accordingly, and with reference to FIG. 5, a system of providing a pair of attachment rings 44, 44' is provided. The rings 44, 44' have a common attachment point 46 at the top side of the ring base 32'. The rings 44, 44' thereby have a spaced-apart relationship at their upper ends. A "V" configuration is formed in cross section.

The cords 18 are selectively attached to the rings 44, 44' whereby twisting of the body portion 20' is minimized.

Having described my invention, however, many modifications thereto will become apparent to those skilled in the art to which it pertains without deviation from the spirit of the invention as defined by the scope of the appended claims.

I claim:

1. A parachute game including a parachute assembly, said assembly comprising:

a body portion;

means suspended from said body portion for retarding the free fall of said body portion as it travels through the air;

means incorporated into said body portion for retarding the free fall of said body portion as it travels through the air;

said means suspended from said body portion comprising a hemispherical canopy;

said hemispherical canopy being attached to said body portion by a plurality of conically arrayed cords;

said body portion having at op end and a bottom side and further including at least one parachute cord attachment ring fitted to said top end of said body portion;

two of said rings being fitted to said top end of said body portion, said rings each having a top end and a bottom end, said two rings being joined at said bottom ends and spaced apart at said top ends.

2. The parachute game of claim 5 further including at least one target at which said assembly is aimed and thrown during game play.

3. The parachute game of claim 2 wherein said target is a hoop.

4. The parachute game of claim 5 wherein said body portion includes at least two directional vanes axially fitted thereto.

5. The parachute game of claim 5 wherein said body portion is weighted.

6. The parachute game of claim 5 wherein said body portion is composed of a foamed polymerized material.

7. The parachute game of claim 5 wherein said body portion includes an externally coated skin.

* * * * *